United States Patent [19]

Toya

[11] Patent Number: 4,513,470

[45] Date of Patent: Apr. 30, 1985

[54] COMBINED STRUCTURE OF HAND-HELD CORDLESS VACUUM CLEANER AND FLASHLIGHT

[75] Inventor: Syouichi Toya, Sumoto, Japan

[73] Assignee: Sanyo Electric Co., Ltd., Osaka, Japan

[21] Appl. No.: 579,718

[22] Filed: Feb. 13, 1984

[30] Foreign Application Priority Data

Jun. 13, 1983 [JP] Japan ..... 58-106551

[51] Int. Cl.[3] ..... A47L 5/24

[52] U.S. Cl. ..... 15/328; 15/339; 15/344; 362/253

[58] Field of Search ..... 15/328, 344, DIG. 1, 15/339; 310/50; 320/2; 362/109, 119, 253, 457

[56] References Cited

U.S. PATENT DOCUMENTS 4,011,624 3/1977 Proett ..... 15/344
4,382,220 5/1983 Marshall et al. ..... 320/2

FOREIGN PATENT DOCUMENTS 3228491 2/1984 Fed. Rep. of Germany ..... 15/344
2114878A 9/1983 United Kingdom ..... 15/344
2117977A 10/1983 United Kingdom ..... 15/344

*Primary Examiner*—Edward L. Roberts
*Assistant Examiner*—Arthur D. Dahlberg
*Attorney, Agent, or Firm*—Darby & Darby

[57] ABSTRACT

A combined structure of a hand-held cordless vacuum cleaner and a flashlight comprises;

a vacuum cleaner body housing therein a battery and an electric powered blower, and including switch means adapted to control power fed to said blower;

a dust case;

a flashlight case including a lighting unit;

specific interconnecting means adapted to releasably interconnect either one of said dust case and said flashlight case to said vacuum cleaner body; and specific electrical connection means adapted to electrically connect said battery in said vacuum cleaner body to said lighting unit in said flashlight case when said flashlight case is interconnected to said vacuum cleaner body by said interconnecting means.

10 Claims, 15 Drawing Figures

FIG. 8
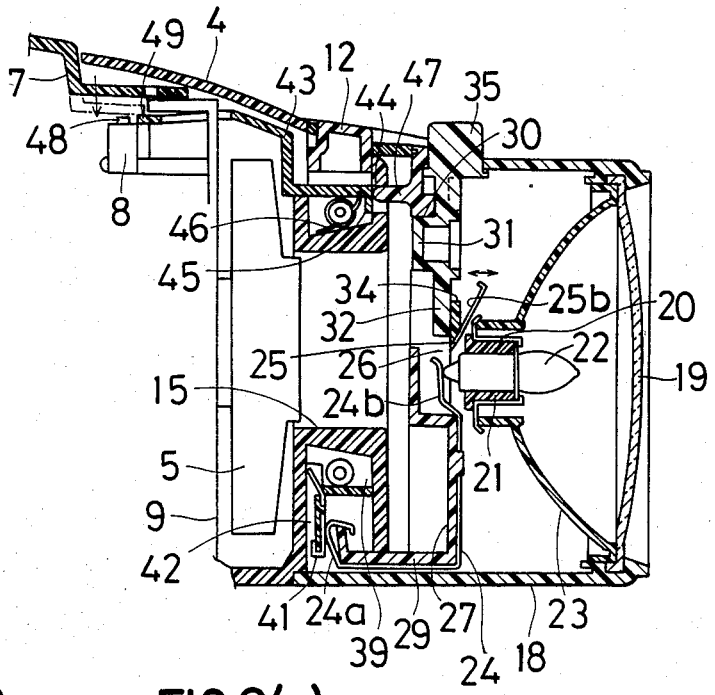
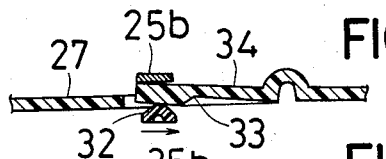
FIG.9(a)
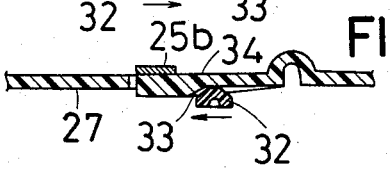
FIG.9(b)
FIG. 10
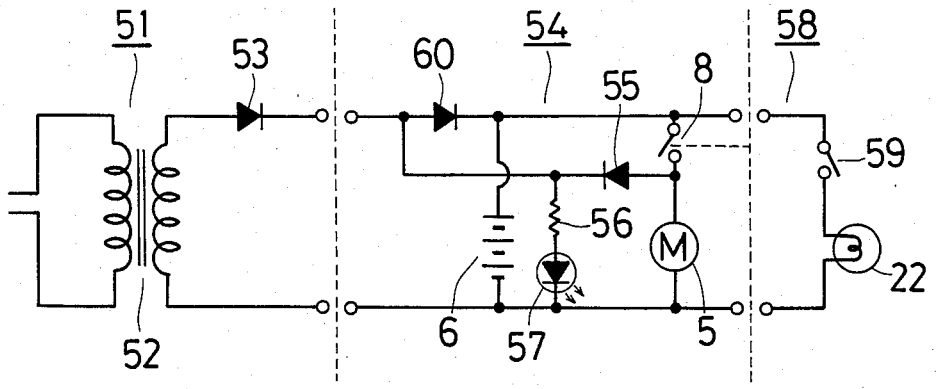

COMBINED STRUCTURE OF HAND-HELD CORDLESS VACUUM CLEANER AND FLASHLIGHT

BACKGROUND OF THE INVENTION

1. Field of the Invention

This invention relates to a combined structure of a hand-held cordless vacuum cleaner and a flashlight, and more particularly to a combined structure of a hand-held cordless vacuum cleaner and a flashlight in which the vacuum cleaner and the flashlight can be selectively used through the interchangeable combination of components and which has high practical value added.

2. Description of the Prior Art

Heretofore, there is known that any one of various tool heads, such as a movable blade assembly, drill, kneader, flashlight, etc., is electrically and mechanically interconnected to a power handle which forms a handle and includes therein a chargeable battery and switch means, thereby permitting the power handle to be commonly used in many applications (e.g., refer to U.S. Pat. No. 3,952,239). The opposite end faces of the power handle and the tool head are formed with sliding fitting portions and include a locking mechanism.

There has been also proposed such a power handle to which a flashlight case or a vacuum cleaner body is screwed releasably (e.g., refer to Japanese Utility Model Publication No.34-5470).

On the other hand, a hand-held vacuum cleaner is usually constructed such that the vacuum cleaner body forming a handle houses therein a chargeable battery and an electric powered blower driven by the battery and further includes switch means adapted to control power fed to the blower, an intake opening for the electric powered blower is formed in the front surface of the vacuum cleaner body, and protective ribs are formed to project over the intake opening.

While a dust case housing therein a filter or other application tools, such as the above-mentioned flashlight case, might be slide-fitted to the front surface of the vacuum cleaner body, this sliding fit is difficult due to the obstructive presence of the protective ribs. Further, fitting with screws has such drawbacks that it is time-consuming and electrical connection with the application tool is troublesome and liable to fail. There is also accompanied a problem that, since the electric powered blower is housed in the vacuum cleaner body, the switch means must be locked when fitting the flashlight case to disable operation of the electric powered blower during use of the flashlight, thereby to prevent dissipation of the battery.

SUMMARY OF THE INVENTION

The present invention resides in a combined structure of a hand-held cordless vacuum cleaner and a flashlight comprising; a vacuum cleaner body having a handle portion, housing therein a battery and an electric powered blower driven by the battery, and including switch means adapted to control power fed to the blower; a dust case housing therein a filter; a flashlight case including a lighting unit and switch means for the lighting unit; interconnecting means adapted to releasably interconnect either one of the dust case and the flashlight case to the vacuum cleaner body; and electrical connection means adapted to electrically connect the battery in the vacuum cleaner body to the lighting unit in the flashlight case when the flashlight case is interconnected to the vacuum cleaner body by the interconnecting means, the interconnecting means composed of; an annular stepped portion formed in the front peripheral edge portion of the vacuum cleaner body; a clamping portion and an engaging portion respectively formed in the upper and lower part of the annular stepped portion; an annular recess formed in the rear peripheral edge portion of each of the dust case and the flashlight case and releasably fitted to the annular stepped portion of the vacuum cleaner body in a substantially fore-and-rear direction; and upper and lower locking portions formed in the vicinity of the annular recess to be respectively locked to the clamping portion and the engaging portion of the annular stepped portion, and the electrical connection means being composed of; a recess formed in the annular stepped portion of the vacuum cleaner body; battery side connection terminals disposed in the recess and led to the battery; and light bulb side connection terminals projected to the annular recess of the flashlight case, led to the lighting unit and coming into the recess in the annular stepped portion of the vacuum cleaner body to be brought into contact with the battery side connection terminals when the flashlight case is interconnected to the vacuum cleaner body.

In other words, the present invention resides in a combination basically consisted of three components; a vaccum cleaner body, a dust case and a flashlight case, and the vacuum cleaner body can be commonly used as a hand-held vacuum cleaner or a flashlight by selectively connecting one of the cases to the vacuum cleaner body. Particularly, since the vacuum cleaner body has the handle portion and houses therein a battery, the flashlight case to be combined with the vacuum cleaner body is reduced in its size and simplified in its construction.

According to the present invention, the means for interconnecting the vacuum cleaner body and each case is basically consisted of the annular stepped portion formed in the front peripheral edge portion of the vacuum cleaner body and the annular recess formed in each case to be releasably fitted to the annular stepped portion in a substantially fore-and-rear direction, whereby it becomes possible to selectively get temporal conjoint of the vacuum cleaner body and one of the cases irrespective of the presence of protective ribs which are usually provided over an intake opening of the vacuum cleaner body. Further, the foregoing annular stepped portion includes the clamping portion and the engaging portion, and the foregoing annular recess includes the locking portions respectively locked to those clamping and engaging portions, to finally effect the secure conjoint. On this occassion, adoption of the above-mentioned temporal conjoint between the annular stepped portion and the annular recess results in better connecting operability as well as simplified construction.

Also, according to the present invention, locking means is provided which automatically locks the switch means on the vacuum cleaner body into the OFF state when the flashlight case is interconnected to the vacuum cleaner body by the interconnecting means mentioned above, whereby the blower in the vacuum cleaner body is prevented from operating needlessly upon erroneous actuation of the switch means.

BRIEF DESCRIPTION OF THE DRAWINGS

FIG. 8 is a sectional view of an essential part of FIG. 2;

FIGS. 9(A) and 9(B) are sectional views taken along the line IX—IX in FIG. 7, showing the operated states different from each other;

FIG. 10 is an electrical circuit diagram including a charging circuit;

DETAILED DESCRIPTION OF THE INVENTION

In the following, the present invention will be described in detail with reference to preferred embodiments illustrated in the accompanying drawings.

Figure 1:
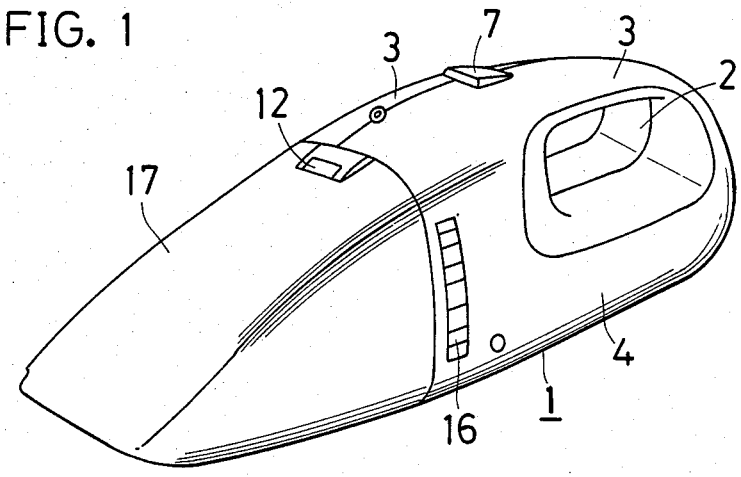
FIG. 1 is a perspective view of one embodiment of a combined structure of a hand-held cordless vacuum cleaner and a flashlight in accordance with the present invention, when used as a vacuum cleaner.
Figure 4:
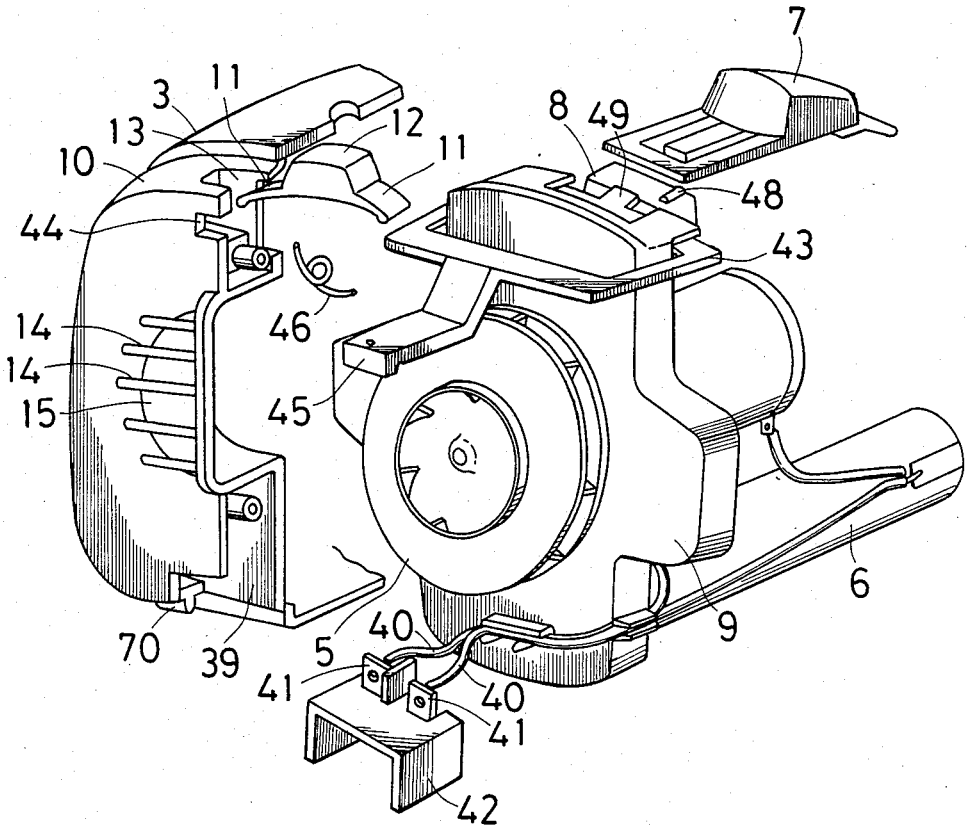
FIG. 4 is an exploded perspective view of an essential part of a vacuum cleaner body in FIG. 3.

Referring first to FIGS. 1 and 4, the reference numeral (1) designates a vacuum cleaner body comprises a body case (4) consisting of laterally symmetrical divided halves (3), (3) and having a handle (2) formed at the upper part thereof, an electrical powered blower (5) and a chargeable battery (6), such as a NiCd battery cell, to feed power to the blower (5) both housed in the body case, a switch controller (7) provided at the upper part of the body case (4) to be movable between the projected and retreated position, and a microswitch (8) adapted to control power fed to the blower (5) from the battery (6).

The electric powered blower (5) is inserted into and held by a frame member (9) supported between the laterally symmetrical divided halves (3) and (3), and the microswitch (8) is disposed at the upper part of the frame member (9). The body base (4) is formed at its front outer periphery with an annular stepped portion (10), and at the upper central part of the annular stepped portion (10) there is provided a clamping button (12) which is movable vertically by a pair of elastic leg pieces (11), (11) and projected out of an opening (13). The body case (4) is also formed in its front surface with an intake port (15) having a plurality of protective ribs (14), (14) . . . provided over the port (15) and locating opposite to the electric powered blower (5). Further, on both sides of the front part of the body case (4) there are formed exhaust ports (16) for the electric powered blower (5).

The reference numeral (17) designates a dust case which is releasably interconnected to the front part of the vacuum cleaner body (1) with a lower engaging portion (70) and the upper clamping button (12) both provided in the annular stepped portion (stated differently, an annular recess formed in the rear peripheral portion of the dust case is fitted to the annular stepped portion of the vacuum cleaner body). The dust case includes at its front part a nozzle-like suction port (not shown) integrally formed therein, and at its rear part a dust collecting filter unit (not shown) releasably provided.

Figure 2:
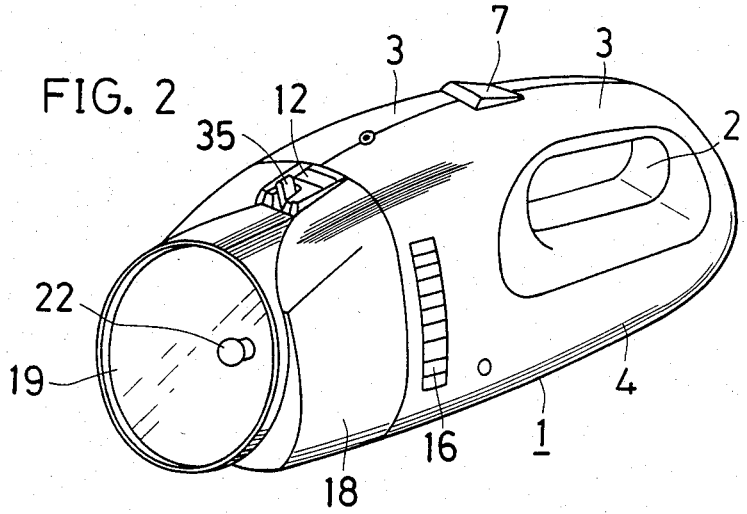
FIG. 2 is a perspective view similar to FIG. 1, when used as a flashlight.
Figure 3:
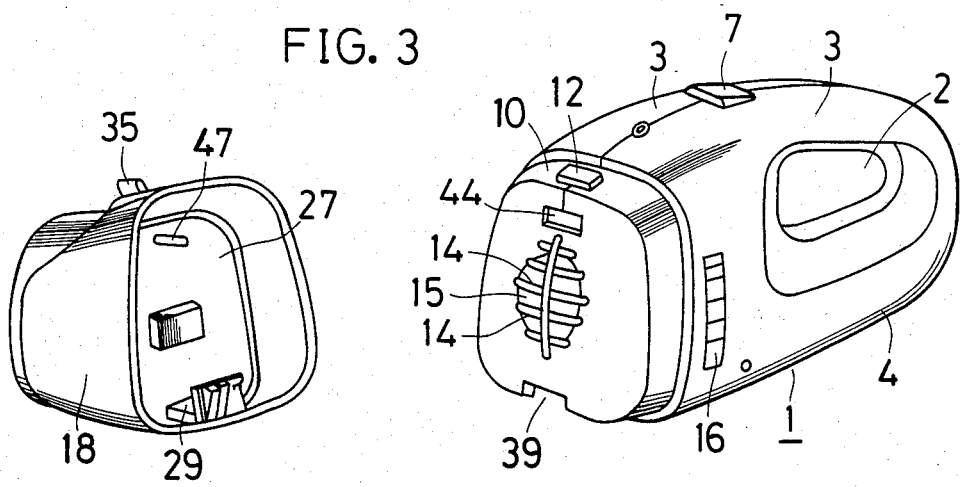
FIG. 3 is an exploded perspective view of FIG. 2.
Figure 5:
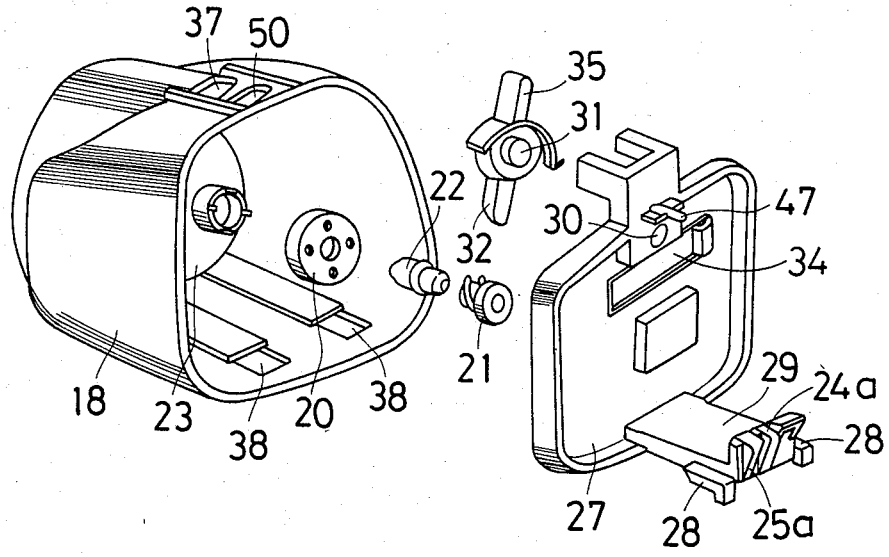
FIG. 5 is an exploded perspective view of a flashlight case in FIG. 3.

The reference numeral (18) in FIG. 2 and FIG. 5 designates a flashlight case which is formed of synthetic resin and releasably interconnected to the front part of the vacuum cleaner body (1) in place of the dust case (17) in FIG. 1. The flashlight case (18) is provided with a lens (19), a reflection mirror (23) including a miniature bulb (22) as a light bulb mounted at its central part by a bulb metal fixture (20) and a bulb retainer (21), and a rear plate (27) including a pair of bulb side connection terminal plates (24), (25) and switch means (26) as shown in detail in FIG. 6.

Figure 6:
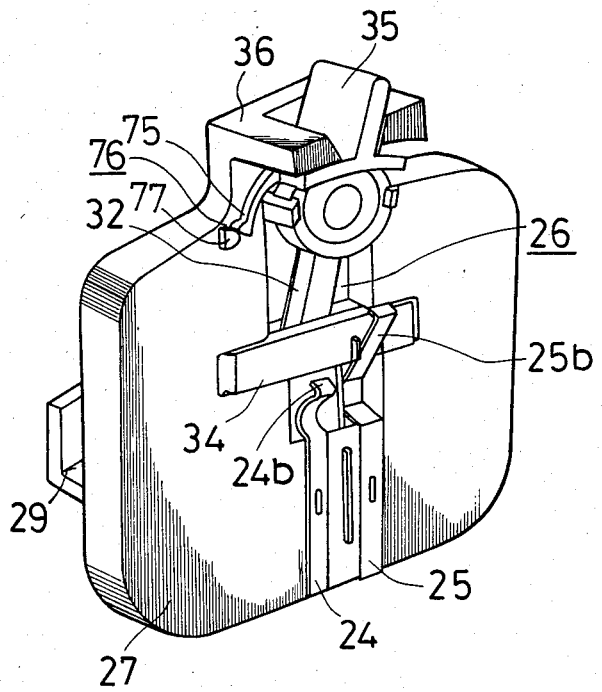
FIG. 6 is a perspective view of a rear plate prior to assembly into a tubular body of the flashlight case.
Figure 7:
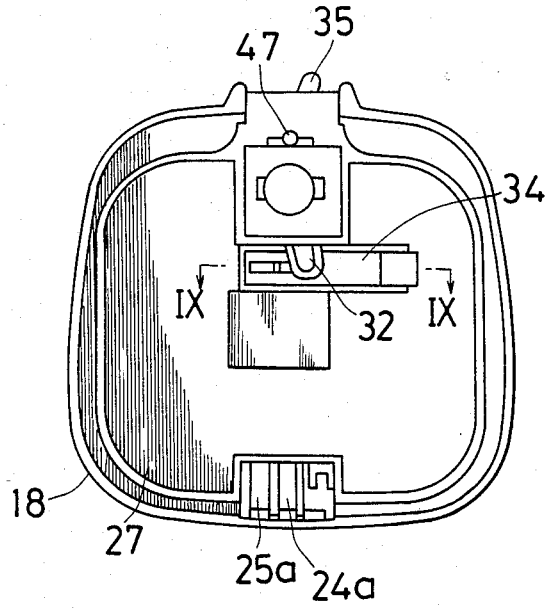
FIG. 7 is a rear view when the rear plate is assembled into the tubular body of the flashlight case.

Referring to FIGS. 5 through 7, the rear plate (27) is formed of a synthetic resin material and cooperates with a tubular body of the flashlight case to form an annular recess in the rear peripheral edge portion of the flashlight case, and this annular recess is fitted to the annular stepped portion of the vacuum cleaner body. Moreover, the rear plate (27) is further provided at its lower part on the side facing the front surface of the vacuum cleaner body (1) with an engaging projected portion (29) which has a pair of right and left ledges (28), (28). One end (24*a*), (25*a*) of each of the paired connection terminal plates (24), (25) is latched to the engaging projected portion (29). The other end (24*b*) of the connection terminal plate (24) is always brought into contact with the miniature bulb (22), whereas the other end (25*b*) of the connection terminal plate (25) is connected to or disconnected from the bulb metal fixture (20) upon turning operation of the switch means (26), thereby to turn the miniature bulb (22) on or off. The switch means (26) is composed of a control lever (32) having its boss portion (31) fitted into an engaging hole (30) formed at the upper part of the rear plate (27) to be angularly movable, and a leaf spring (34) formed integrally with the rear plate (27) and having a stepped portion (33), see FIG. 9, which moves forth and back in interlock relation with the control lever (32) thus causing the other end (25*b*) of the connection terminal plate (25) to come into contact or non-contact with the bulb metal fixture (20). The rear plate (27) is fixedly mounted in a rear opening of the flashlight case (18) such that an upper projected portion (see FIG. 6) of the rear plate (27) for accommodating a knob portion (35) of the control lever (32) is engaged with a front locking hole (37) (see FIG. 5) formed in the upper surface of the flashlight case (18), and the ledges (28), (28) provided on both sides of the lower engaging projected portion (29) are respectively engaged with parts of a pair of locking holes (38), (38) formed in the lower surface of the flashlight case (18). It is to be noted that the remaining parts of the locking holes (38), (38) receive the corresponding lower engaging portions (70) (see FIG. 4) on the vacuum cleaner body. The reference numeral (76) designates a click stop mechanism for the switch means (26), comprising an elastic arm (75) and a projection (77).

As illustrated in FIG. 4, the body case (4) is formed in the bottom on the intake port side with a recess (39) opened downwardly. In this recess (39) there is housed a resin molded part (42) including a pair of battery side connection terminal plates (41), (41) connected to the battery (6) through lead wires (40), (40), When the flashlight case (18) is interconnected to the vacuum cleaner body (1), the connection terminal plates (24), (25) on the flashlight side are brought into contact with the connection terminal plates (41), (41) on the battery side, as shown in FIG. 8, so as to feed power to the miniature bulb (22) for lighting.

Referring particularly to FIGS. 4 and 8, the reference numeral (43) designates a slide plate which is slidably disposed between the upper wall of the body case (4) and the microswitch (8) attached to the frame member (9). The slide plate (43) has its one end (45) normally biased by a spring member (46) to be exposed flush with an window opening (44) formed above the inlet port of the body case (4). When the flashlight case (18) is interconnected to the vacuum cleaner body (1), the slide plate (43) exposing to the window opening (44) is pushed inward by a boss or projection (47) provided on the rear plate (27) of the flashlight case (18), so that a projected portion (49) of the slide plate (43) is moved toward a switch knob (48) of the microswitch (8). In this state, even when the switch controller (7) disposed at the upper part of the body case (4) is pressed down, the switch controller (7) strikes against the projected portion (49) of the slide plate (43) to prevent the switch knob (48) from being pushed down, so that the microswitch (8) will not come into the ON state. In other words, the microswitch (8) is brought into the locked state. It is to be noted that the reference numeral (50) (FIG. 5) designates a locking hole formed in the flashlight case (18) to be engaged with the clamping button (12) on the vacuum cleaner body (1).

Referring now to FIG. 10 there is shown an electrical circuit diagram, the reference numeral (51) designates a circuit in a charging stand (not shown), which comprises a transformer (52) and a diode (53). Designated at (54) is a circuit in the vacuum cleaner body (1), in which the battery (6) is connected to a circuit comprising the electric powered blower (5), a diode (55), a resistor (56) and a light emitting diode (57). Further, designated at (58) is a circuit in the flashlight case (18), which comprises the miniature bulb (22) and a switch (59). When the flashlight case (18) is interconnected to the vacuum cleaner body (1), the microswitch (8) is held in the open state. Designated at (60) is a diode for preventing the current from passing through the light emitting diode (57) alone.

Since the combined structure of the hand-held cordless vacuum cleaner and the flashlight is constructed as described above, the vacuum cleaner body can be commonly used for two different purposes by interconnecting the flashlight case to the vacuum cleaner body in place of the dust case which is normally fitted to the body in a releasably manner, whereby the range of uses is increased. Further, the connection terminals provided in the lower engaging portions permits the electrical connection simultaneously with the mechanical connection, thereby resulting in simplified handling. Moreover, the switch on the vacuum cleaner body is automatically locked when the flashlight case is interconnected thereto, so that erroneous operation is eliminated and the service life of a battery is prolonged.

Referring now to FIGS. 11 through 14, the reference numeral (112) designates a seesaw-like clamping plate which is pivoted on a flame member (109) by a pin (161) above the annular stepped portion formed in the front peripheral edge portion of a vacuum cleaner body (101). The clamping plate (112) is clamped to an upper locking portion (162) of a dust case (117) in the state shown in FIGS. 11 and 12, and it is similarly clamped to an upper locking portion (163) of a flashlight case (118) in the state shown in FIGS. 13 and 14.

The clamping plate (112) is integrally formed at its rear part with a locking piece (174) adapted to automatically lock switch means (microswitch) (108) in the vacuum cleaner body into the OFF state when the flashlight case (118) is fitted to the vacuum cleaner body (101). More specifically, the level of the clamping plate (112) when it is locked by the upper locking portion (163) of the flashlight case (118) is selected lower than that when it is locked by the upper locking portion (162) of the dust case (117), whereby the locking piece (174) is held in a lower position when the flashlight case (118) is fitted to the vacuum cleaner body (101). As a result, operation of a control lever (107) is surely prevented.

Figures 11, 12:
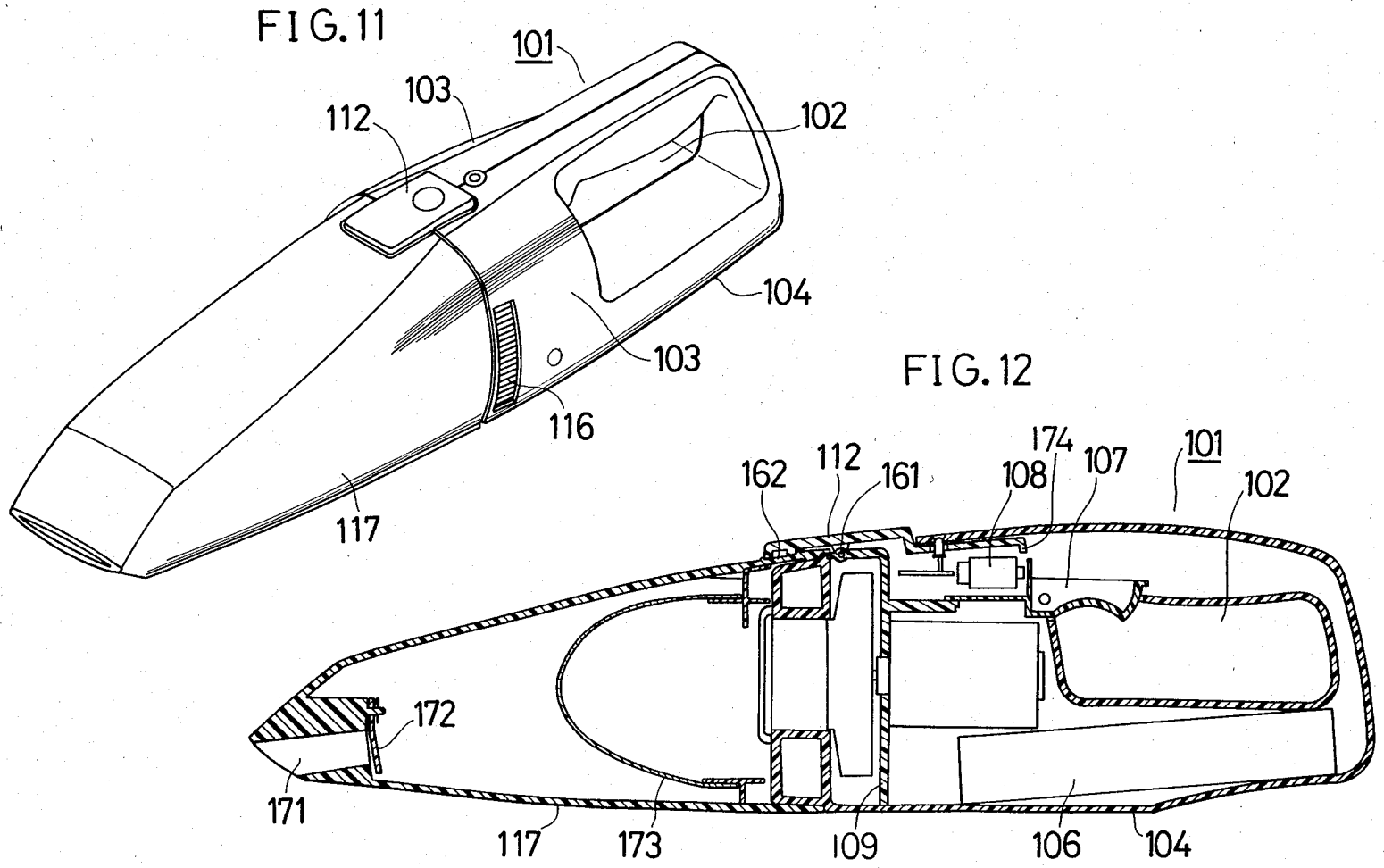
FIG. 11 is a perspective view of another embodiment of the present invention when used as a vacuum cleaner.
FIG. 12 is a longitudinal sectional view of FIG. 11.
Figure 14:
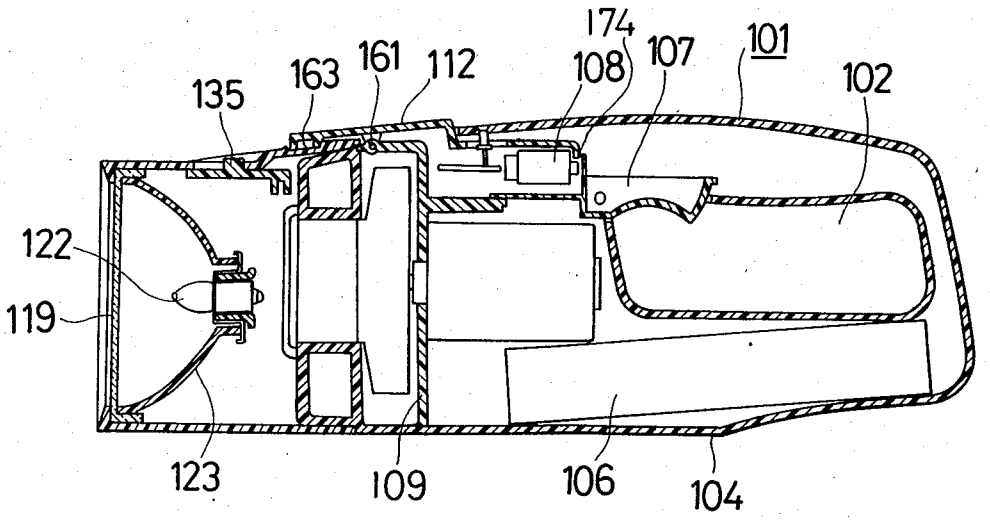
FIG. 14 is a longitudinal sectional view of FIG. 13.
Figure 13:
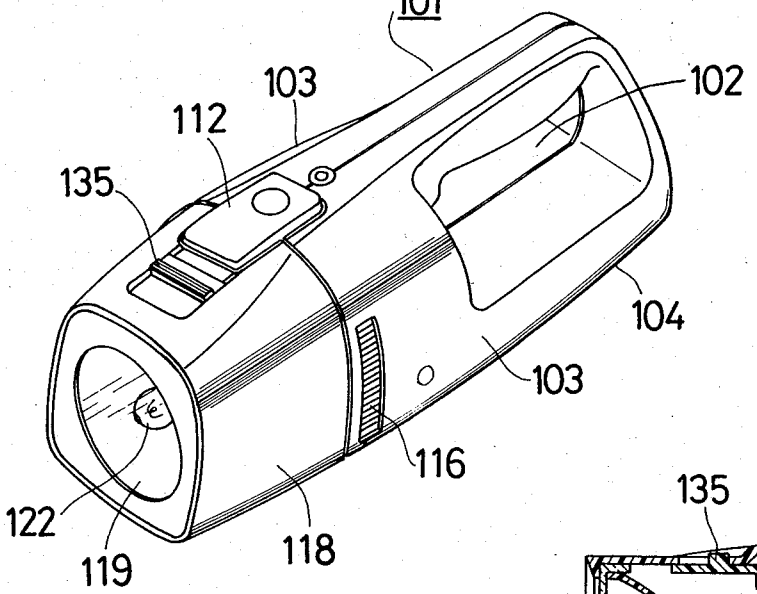
FIG. 13 is a view similar to FIG. 11, when used as a flashlight.

In FIG. 12, designated at the reference numeral (171) is a nozzle-like suction port, (172) is a rubber plate serving to prevent the reverse flow through the suction port, and (173) is a dust collecting filter. Other configuration is similar to that as illustrated in FIGS. 1 through 10 and, therefore, further description will be dispensed with.

What is claimed is:

1. A combined structure of a hand-held cordless vacuum cleaner and a flashlight comprising;

a vacuum cleaner body having a handle portion, housing therein a battery and an electric powered blower driven by said battery, and including switch means adapted to control power fed to said blower;

a dust case housing therein a filter;

a flashlight case including a lighting unit and switch means for said lighting unit;

interconnecting means adapted to releasably interconnect either one of said dust case and said flashlight case to said vacuum cleaner body; and electrical connection means adapted to electrically connect said battery in said vacuum cleaner body to said lighting unit in said flashlight case when said flashlight case is interconnected to said vacuum cleaner body by said interconnecting means, said interconnecting means being composed of; an annular stepped portion formed in the front peripheral edge portion of said vacuum cleaner body; a clamping portion and an engaging portion respectively formed in the upper and lower part of said annular stepped portion; an annular recess formed in the rear peripheral edge portion of each of said dust case and said flashlight case and releasably fitted to the annular stepped portion of said vacuum cleaner body in a substantially fore-and-rear direction; and upper and lower locking portions formed in the vicinity of said annular recess to be respectively locked to the clamping portion and the engaging portion of said annular stepped portion, and said electrical connection means being composed of; a recess formed in the annular stepped portion of said vacuum cleaner body; battery side connection terminals disposed in said recess and led to said battery; and light bulb side connection terminals projected to the annular recess of said flashlight case, led to said lighting unit and coming into the recess in the annular stepped portion of said vacuum cleaner body to be brought into contact with said battery side connection terminals when said flashlight case is interconnected to said vacuum cleaner body.

2. A combined structure according to claim 1, wherein said interconnecting means further includes locking means adapted to automatically lock said switch means on said vacuum cleaner body into the OFF state when said flashlight case is interconnected to said vacuum cleaner body.

3. A combined structure according to claim 2, wherein said locking means comprises; a projection provided in the annular recess in said flashlight case; and a slide lever arranged in said vacuum cleaner body to be slid by said projection when said flashlight case is interconnected to said vacuum cleaner body, thereby to lock said switch means on said vacuum cleaner body into the OFF state.

4. A combined structure according to claim 2, wherein said upper locking portion is formed in the upper outer wall surface of each annular recess of said dust case and said flashlight case, said clamping portion is formed of a seesaw-like molded member pivoted to the upper part of the annular stepped portion of said vacuum cleaner body, and the front end part of said molded member is locked to said upper locking portion when each of said cases is interconnected to said vacuum cleaner body;

and wherein said locking means is a locking piece formed at the rear end part of said seesaw-like molded member for locking said switch means on said vacuum cleaner body into the OFF state when said flashlight case is interconnected to said vacuum cleaner body.

5. A combined structure according to claim 1, wherein said flashlight case is composed of; a tubular body; a lighting unit accommodated at the front part within said tubular body; switch means for said lighting unit; and a rear plate accommodated at the rear part within said tubular body to cooperate with said tubular body thereby to form said annular recess.

6. A combined structure according to claim 5, wherein said rear plate includes bulb side connection terminals led to said lighting unit, and said switch means.

7. A combined structure according to claim 6, wherein said switch means is composed of; a leaf spring formed integrally with said rear plate; a power feeding terminal extended from one of said bulb side connection terminals; and a control lever having an upper portion projected to the outside from a through hole formed in said tubular body and actuated upon operation of said projected portion thus causing said power feeding terminal to come into contact or non-contact with said lighting unit via said leaf spring.

8. A combined structure according to claim 6, wherein said rear plate has an upper guiding projection adapted to guide said control lever and a lower projection adapted to support said bulb side connection terminals, and these projections are respectively fixedly fitted into corresponding opening formed in said tubular body.

9. A combined structure according to claim 1, wherein said lighting unit comprises a reflection mirror provided a miniature bulb and a lens for covering the front of said reflection mirror.

10. A combined structure according to claim 1, wherein said battery is of a chargeable battery.

* * * * *